US008221124B2

(12) United States Patent
Ferguson et al.

(10) Patent No.: US 8,221,124 B2
(45) Date of Patent: Jul. 17, 2012

(54) METHODS AND APPARATUS FOR EDUCATING

(75) Inventors: Todd Bruce Ferguson, Hawthorn Woods, IL (US); Richard Goodman, Glenview, IL (US)

(73) Assignee: Professor Brainstorm, LLC, Lincolnshire, IL (US)

( * ) Notice: Subject to any disclaimer, the term of this patent is extended or adjusted under 35 U.S.C. 154(b) by 484 days.

(21) Appl. No.: 12/492,842

(22) Filed: Jun. 26, 2009

(65) Prior Publication Data

US 2010/0003649 A1 Jan. 7, 2010

Related U.S. Application Data

(60) Provisional application No. 61/076,506, filed on Jun. 27, 2008.

(51) Int. Cl.
*G09B 19/22* (2006.01)

(52) U.S. Cl. ..... 434/128

(58) Field of Classification Search ..... 434/128, 434/129, 167, 171, 172, 176, 188, 191, 205, 434/365, 403; 273/272, 299, 302
See application file for complete search history.

(56) References Cited

U.S. PATENT DOCUMENTS

| | | | | | |
|---|---|---|---|---|---|
| 3,267,590 | A * | 8/1966 | Browning | 273/272 |
| 3,904,207 | A * | 9/1975 | Gold | 273/272 |
| 5,306,153 | A * | 4/1994 | Foster | 434/170 |
| 5,338,203 | A * | 8/1994 | Rheams | 434/208 |
| 5,374,065 | A | 12/1994 | Motskin | |
| 5,445,390 | A * | 8/1995 | Dutton et al. | 273/243 |
| 5,653,594 | A * | 8/1997 | Lai | 434/209 |
| 5,662,332 | A | 9/1997 | Garfield | |
| 5,788,503 | A * | 8/1998 | Shapiro et al. | 434/172 |
| 5,803,742 | A * | 9/1998 | Buti | 434/157 |
| 5,863,043 | A * | 1/1999 | Bitner | 273/299 |
| 5,893,718 | A * | 4/1999 | O'Donnell | 434/128 |
| 5,906,492 | A * | 5/1999 | Putterman | 434/169 |
| 6,251,010 | B1 | 6/2001 | Tajiri et al. | |
| 6,276,940 | B1 * | 8/2001 | White | 434/172 |
| RE37,957 | E | 1/2003 | Garfield | |
| 6,601,851 | B1 | 8/2003 | Sakamoto et al. | |
| 7,044,467 | B1 * | 5/2006 | Dimmig | 273/272 |
| 7,144,013 | B2 | 12/2006 | Tanaka | |
| 7,182,342 | B1 * | 2/2007 | Fulton, Jr. | 273/272 |
| 7,220,126 | B2 * | 5/2007 | Glymph | 434/191 |
| 7,367,564 | B2 * | 5/2008 | Latell | 273/299 |
| 7,500,852 | B2 * | 3/2009 | Wolf et al. | 434/188 |
| 2006/0202423 | A1 | 9/2006 | Tanaka | |
| 2006/0273510 | A1 | 12/2006 | Pelzel et al. | |
| 2007/0045962 | A1 | 3/2007 | Tanaka | |

* cited by examiner

*Primary Examiner* — Kurt Fernstrom
(74) *Attorney, Agent, or Firm* — Fitch, Even, Tabin & Flannery, LLP

(57) ABSTRACT

A method of educating includes providing a collectible trading card game with a plurality of trading cards. Each card may contain educational information including a consonant, vowel, number or mathematical operator and the cards are used to form a properly spelled word or to form a mathematically correct equation. In some forms, the method includes providing a game with a playing field and a set of game components with game component types having a predetermined power for affecting play of the game by affecting a power, effect, or value of the game component. The level of skill necessary to play the game may be varied by selectively implementing or disregarding the predetermined power of the game components. An educational game includes first and second game components with different expressions, powers, point values, and identifiers for distinguishing game components and facilitating game play.

21 Claims, 13 Drawing Sheets

METHODS AND APPARATUS FOR EDUCATING

CROSS-REFERENCE TO RELATED APPLICATION

This application claims the benefit of U.S. Provisional Application No. 61/076,506 filed Jun. 27, 2008 which is hereby incorporated herein by reference in its entirety.

FIELD OF THE INVENTION

The invention relates to methods and apparatuses for educating, and more particularly, to methods and apparatuses for educating using an expression-forming game.

BACKGROUND OF THE INVENTION

Collectible and trading card games are well known in the art and have proven to be very successful with children and adults of all ages. Such games are normally played using a deck of cards, which may be expanded through purchase of expansion sets, or buying or trading individual cards. Additional cards may also be obtained through winning cards from an opponent during game play. Examples of such games include "battle" games, wherein two or more players compete against one another using their cards to score points or reduce the other players' score until a player wins. Such games often use fantasy elements, such as real or mythical creatures and characters displayed on each card. Each card may have its own power or effect on other cards, and the players use strategy to determine the proper time to play cards having certain effects.

Although fantasy card games have proven to be very popular with children and young adults, such games are often banned from the classroom, because they lack formal educational value, and can be distracting from the prescribed coursework. Because students that play these games often become preoccupied with the games instead of focusing on their studies, the playing of such games in educational settings is generally frowned upon.

Word building games are also known in the art. Scrabble® is a well known board game wherein at least two players form words on a board using letter tiles. Each letter tile has a point value, and a player wins points by forming a word with his letter tiles and summing the points of each letter tile used to form the word. Each player takes turns forming a single word in a crossword puzzle like manner, building off of words already formed on the board until a player wins. The board contains tile spaces for each tile. Certain tile spaces have score multipliers, such that the tile on that space, or a word having a letter tile that covers that space, will be worth additional points.

BRIEF DESCRIPTION OF THE DRAWINGS

To understand the present invention, it will now be described by way of example, with reference to the accompanying drawings in which.

DETAILED DESCRIPTION OF PREFERRED EMBODIMENTS

Figure 1:
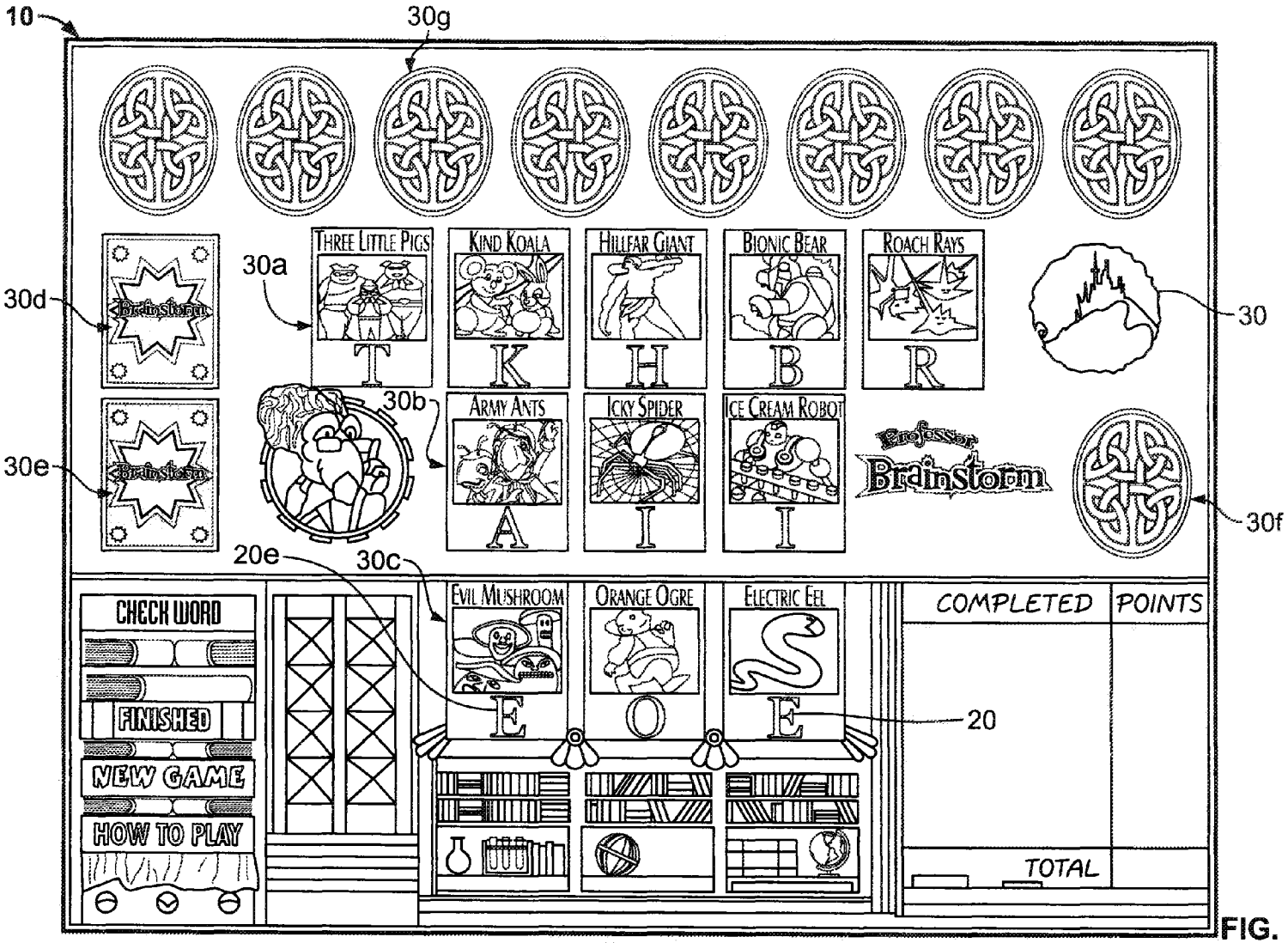
FIG. 1 is a plan view of a screen shot of an electronic version of an educational game in accordance with the present invention, illustrating representations of playing cards displayed on a playing field.

In a preferred embodiment, such as illustrated in FIGS. 1-17, an educational game comprises a plurality of game components, such as playing or trading cards 20, each having educational information disposed thereon. The educational information is preferably in the form of expression portions, such as letters of the alphabet, or alternatively numbers and mathematical operators, although other educational information may be utilized in other forms in accordance with the invention. The playing cards 20 preferably have character information disposed thereon to make the cards suitable for collecting. Generally, the playing cards 20 are utilized by one or more users in an ordered fashion to form an expression comprised of expression portions from each of the cards played. In one form, the expression may be a word formed by individual letters 20*e* (FIGS. 1, 3 and 4) disposed on each card. In another form, the expression may be a mathematical expression formed from operators and operands, such as mathematical operators 20*y* (FIGS. 11 and 12) and numbers 20*x* (FIGS. 11 and 13-15). By playing a game in accordance with the present invention, the user may obtain numerous educational benefits, including learning and applying spelling strategies, deepening phonemic understanding, learning high frequency words, learning to use affixes, developing proof reading skills, using rime or generative patterns found in word families (e.g. ate, late, rate, gate, etc.), improving mathematical and building problem solving skills, and using strategy. The game is also adaptable to accommodate players of varying abilities and experience by removing or disregarding advanced elements of the game. The educational games described herein have also been found to be effective to teach children with learning or developmental disabilities and special needs children.

The word-forming game 10 (FIG. 1) in accordance with one form of the present invention combines the intrinsic interest of trading cards with the literacy benefits of an educational game. Unlike traditional educational cards or flash cards, the trading cards 20 feature alphabetic letters with phonemically matching character names combined with pop culture art. This unique combination, along with the trading card structure, adds meaning to game play, letter identification, reading, and phonics. The backs of the cards 20*a* (FIGS. 5-8) are also phonemically unique and use colors to differentiate, as well as accentuate, the vowel cards 20*ab* (FIG. 3) from the consonant cards 20*aa* (FIG. 4). The orange cards are preferably vowel cards 20*ab* and the blue cards are consonant cards 20*aa*. Using two colors enhances phonemic analysis by visually accentuating the vowel and consonant patterns found in English words called phonograms. When second language learners play the word-forming game 10, they self-discover English vowel patterns through word-building during play. Brain research has indicated that learning through multiple modalities, such as visual, verbal and tactile means (i.e., seeing, saying and doing), combined with motivational and social interaction increases student achievement. The game 10 provides this cognitive stimulus simultaneously while players are engaged in play, and thereby provides advantages over traditional rote memory exercises, worksheets, and flash card methods used in schools and in the home. Traditional methods often fail to keep students engaged and do not motivate them to want to learn more at ever increasing levels. The word-forming game 10 motivates students' desire to learn more because they earn points for fluently reading the cards and using spelling strategies. Thus, players are often unaware they are learning.

Ultimately, individuals that play the game 10 will learn to see generative patterns in words, which has several benefits, such as improving spelling skills, i.e. encoding, which leads to more fluent writing ability. Players will also become more fluent readers, as they will be more efficient when sounding out unknown words, i.e. decoding, as they read in context. The faster a reader decodes, the less comprehension is lost, which is an important skill when reading, but an essential skill when reading about new ideas or concepts such as in a text book or other nonfiction source.

Figure 2:
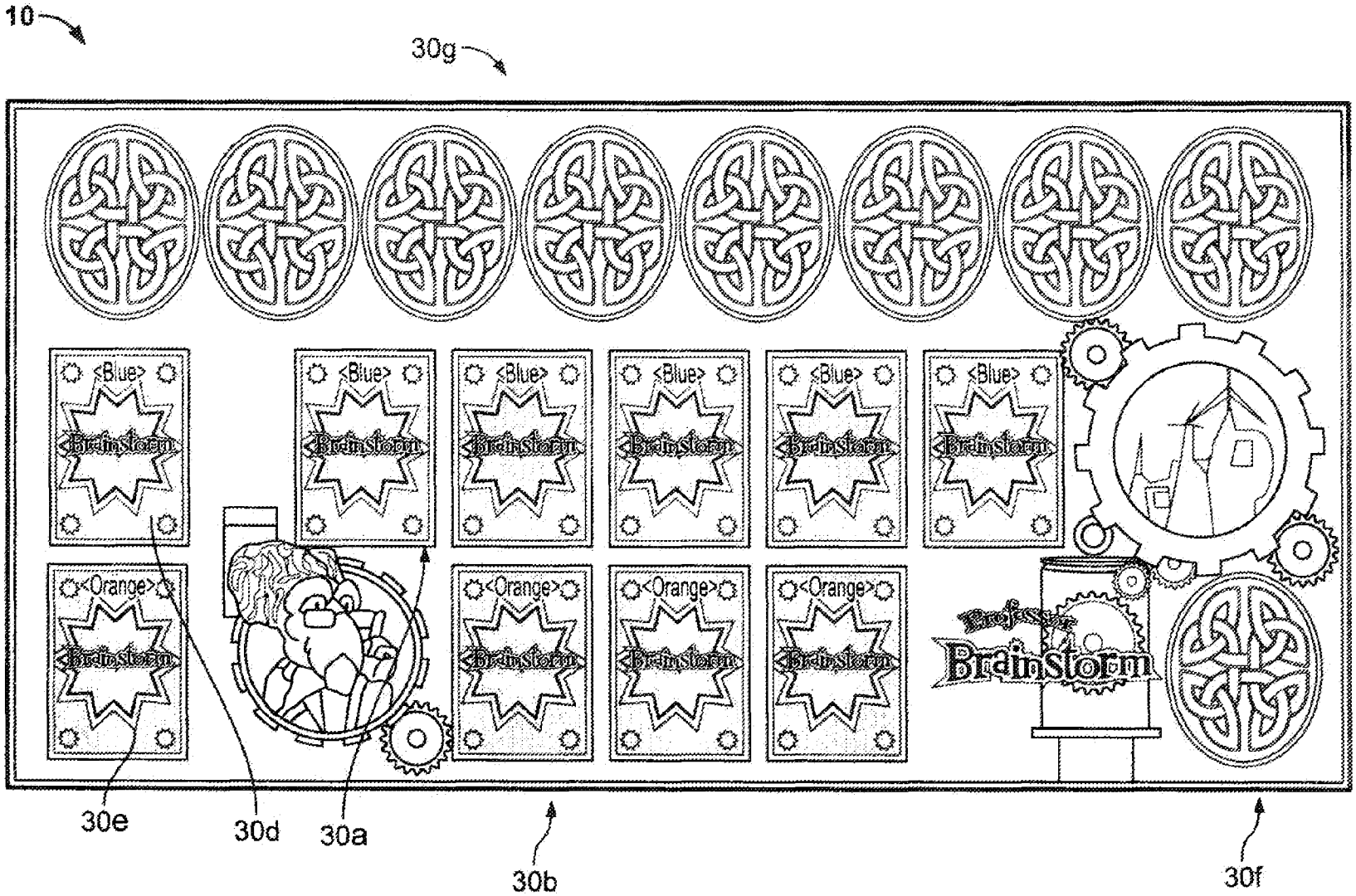
FIG. 2 is a plan view of a playing field used in a physical version of an educational game in accordance with the present invention.

A typical game setup 10 in accordance with the present invention is disclosed in FIGS. 1 and 2. Playing cards 20 are played face-up on a playing field 30 having a plurality of subfields, such as first, second, and third rows for holding the playing cards 20. The first, second, and third rows include an upper tier or base 30*a* and a lower tier or base 30*b* for holding playing cards 20 and an uppermost expression field or shield field 30*g*, wherein cards 20 are placed into play and organized into expressions, e.g., words or mathematical expressions. Additional playing cards 20 are held hidden from other players, such that the faces of the cards 20 are kept hidden from view of the other players. These additional cards may be referred to as the blind or the pocket and may be held in the user's hand, or placed face down on the playing field 30. In the embodiment, illustrated in FIG. 1, the individual player is not playing another player, thus, the cards from the blind or pocket 30*c* are shown face up. However, if the player was playing another individual those cards would be kept face down or hidden from view of the other players.

Two separate sets or libraries of playing cards 20, which are differentiated via different indicia, such as colors on the backs of the cards 20*a*, are positioned at predetermined locations on the playing field 30, such as a blue deck field 30*d* for the blue deck pile and an orange deck field 30*e* for the orange deck pile. The upper and lower bases 30*a*, 30*b* are color coded to match the backs of the cards 20*a*. Accordingly, the upper base 30*a* is blue and the lower base 30*b* is orange. The playing field 30 also includes an effect subfield 30*f*, wherein cards 20 having an effect property may be played by a user to affect the point values of other cards 20, or affect game play in some manner to adjust the offensive or defensive advantage of one of the players. An expression field or shield field 30*g* is disposed along the upper margin of the playing field 30 wherein playing cards 20 from the upper and lower tiers 30*a*, 30*b*, as well as the pocket 30*c* may be played to form an expression. The shield field 30*g* preferably has 8 spaces for cards. Although it is preferred that a mat or board be used for the playing field 30 in a physical embodiment of the present invention, no physical playing field is required, and players may play on any surface.

Figure 3:
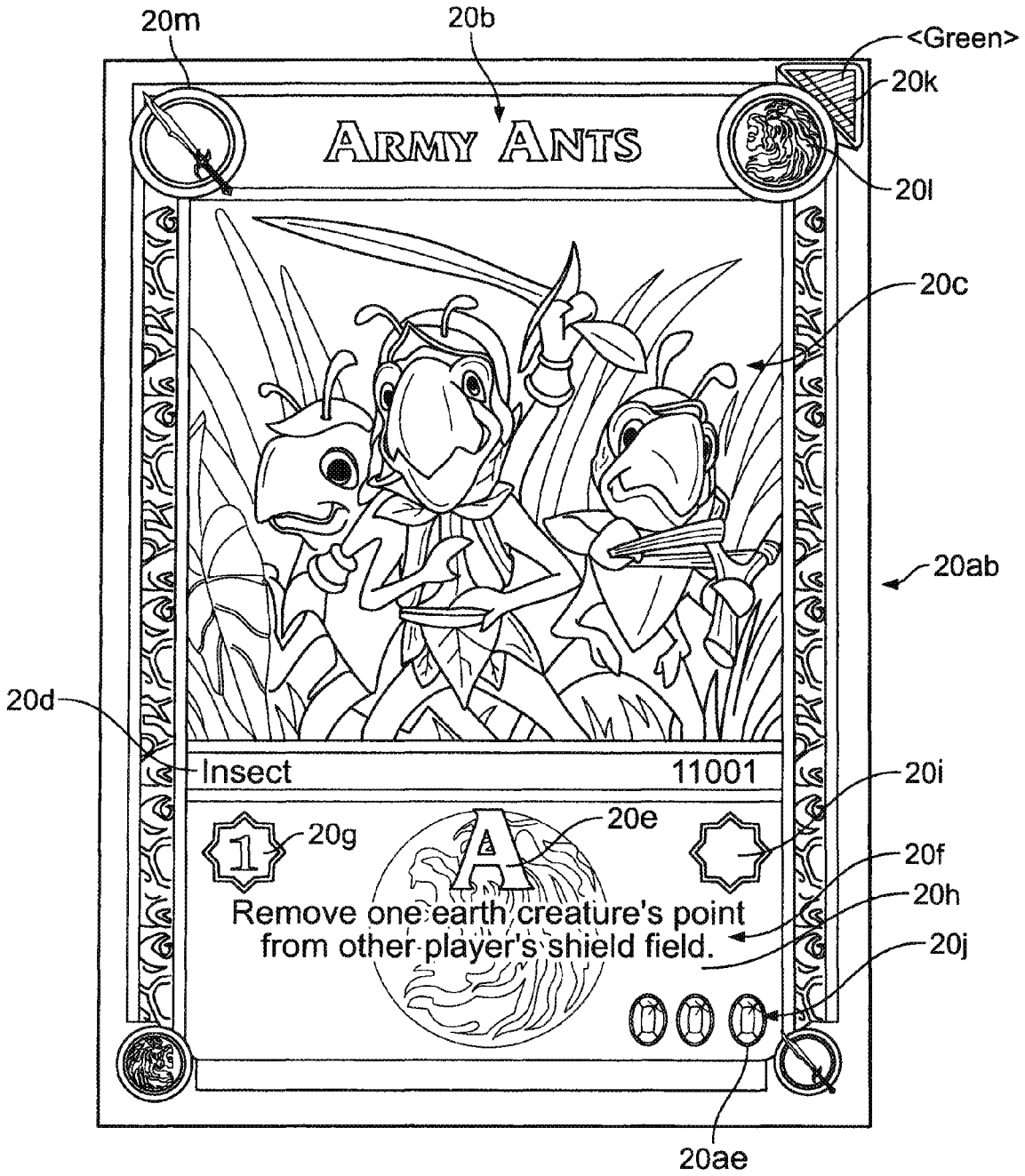
FIG. 3 is a plan view of a playing card in accordance with the present invention illustrating a title, a character illustration, a letter, a point value, an effect, a currency designation, and other information.
Figure 4:
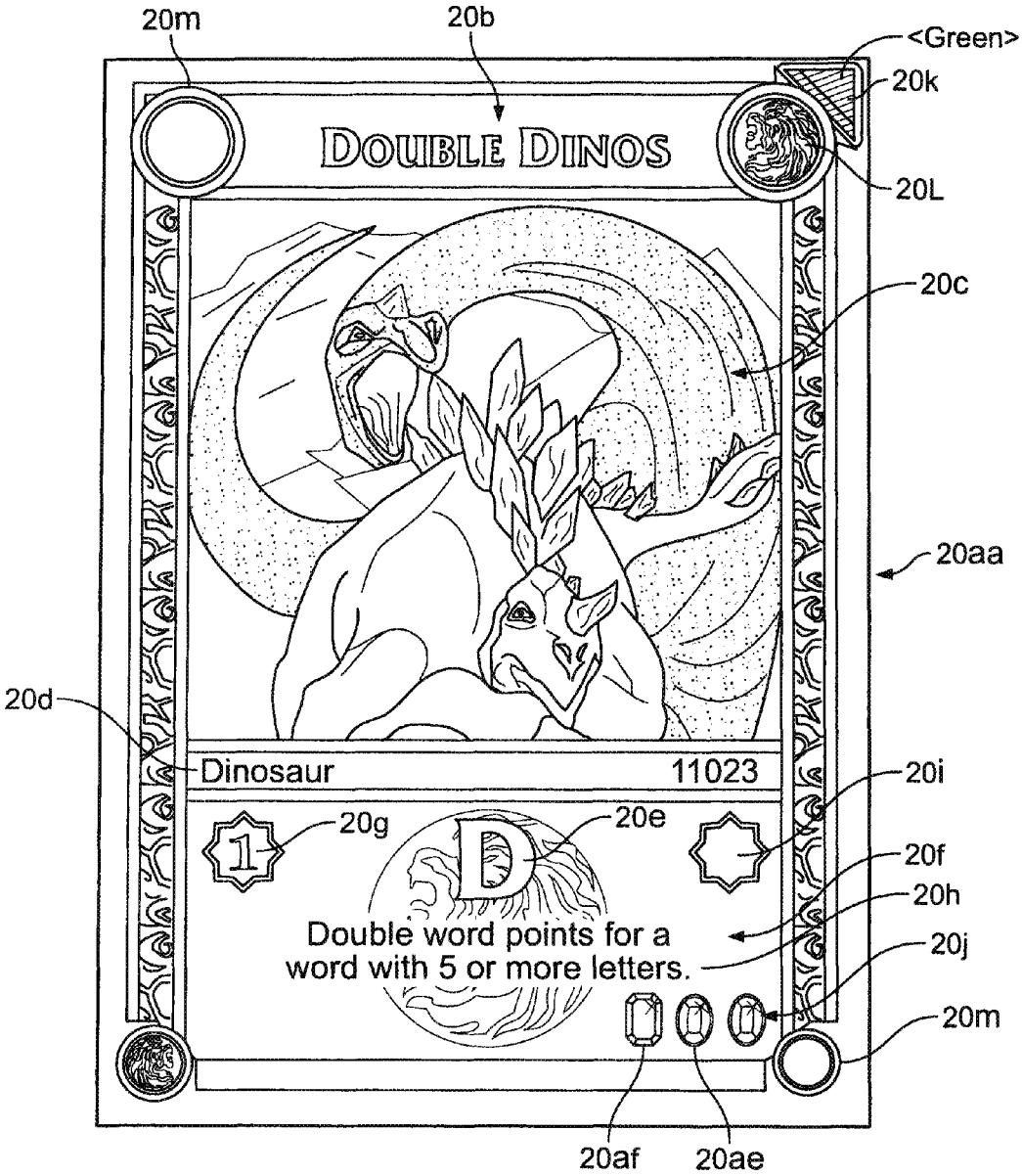
FIG. 4 is a plan view of an alternate playing card in accordance with the present invention illustrating an alternate title, character illustration, letter, effect, currency designation, and other information.

As shown in FIG. 3, each playing card 20 preferably includes character information, such as a title portion 20*b*; a graphic area, such as character illustration 20*c*; character type information 20*d*; the educational information, for example an expression portion, such as a letter of the alphabet 20*e*; a narrative such as a card description 20*f*; a point value 20*g*; an effect 20*h*; an effect duration indicator 20*i*; a currency designator 20*j*; a card type designator, such as an elemental designator 20*k*; a kingdom identifier 20*l*; an offensive or defensive effect indicator 20*m*; an effect indicator (in lieu of a kingdom identifier), and other information. These elements will be described in greater detail below.

The title portion or card name 20*b* displays the name of the card and identifies the character illustrated in the character illustration 20*c*. Preferably, the name of the card is related to the letter of the alphabet 20*e*. For example, in FIG. 3, the card name is "Army Ants" and the expression portion is the letter "A". This association between the card name 20*b* and the letter 20*e* helps the user quickly identify the letter associated with the card, and assists users with reading and spelling skills by associating a memorable illustration and the card name 20*b* with the relevant letter 20*e*. The name of the card 20*b* may also be associated with the power or effect of a given card 20. For example, as shown in FIG. 4, the card name 20*b* is "Double Dinos," and the card's effect 20*h* is to double the user's word point total if the word has 5 or more letters. The association between card name 20*b* and effect 20*h* has educational value (in this case in the mathematical concept of doubling or multiplying by two) and is helpful for reminding the user about a card's effect 20*h* without the need to read the card description 20*f* every time the card is played.

The illustration 20*c* generally contains an illustration of a character and provides the user with a visually interesting and memorable image with which to associate the card 20. The illustration 20*c* may help spark the user's imagination and adds intrigue to the game. As with the association between the card name 20*b* and the letter 20*e*, it is preferable that the illustration 20*c* be related to the letter 20*e* and/or the card name 20*b* to help the individual identify the letter 20*e* and/or the card name 20*b*. For example, individuals who are just beginning to learn the alphabet may already know what the illustration 20*c* (FIG. 3) is showing (e.g., Ants) and will use this association to come up with the letter 20*e* on the card (e.g., "A" for "Ants"). Over time, these associations will further help the individual learn to read and spell the card name 20*b* in that they know from association what is illustrated (e.g., Ants wearing helmets) and the letter 20*e* associated with this card (e.g., "A"). Thereby eventually learning to read and spell the card name 20*b* (e.g., "Army Ants"). In other instances, the individual may not be able to identify the illustration 20*c* on the card but will know either the letter 20*e* or the card name 20*b*. Overtime, the individual will also learn what illustration 20*c* is of and, thus, will learn more than just how to read or spell.

In the form illustrated, the character type information 20*d* generally categorizes or groups the character illustrated in the character illustration 20*c* into different groups or families. Families may include insect, fish, robot, dragon, horse, magic, dinosaur, bird, cat, brainforce, construction effect, weather effect, celestial effect, and geological effect. It should be understood, however, that other types of characters or symbols may be used for the illustration if desired. Preferably, however, these illustrations will maintain some form of association between the card name and/or the letter to help teach the individual some lesson, such as the one discussed above.

In the illustrated embodiment, the families are significant for game play in that certain families are susceptible or not susceptible to the effects of other cards 20. For example, a frog card may have an effect on insect cards, such as "eating" or taking the points away from an insect card. Because it will be learned or may already be commonly understood that frogs eat insects, a player with an insect card would refrain from playing that card if another player plays a frog card. By basing the effects 20*h* associated with a creature on known characteristics of the real-life creature on which the character is based, a user may quickly ascertain whether a card may have an effect on his selected cards 20. This association makes the effects 20*h* of a given card more memorable, thus increasing ease and quickness of play, and also works through association to teach the individual something educational if the individual did not already know this (e.g., frogs eat insects).

Figure 7:
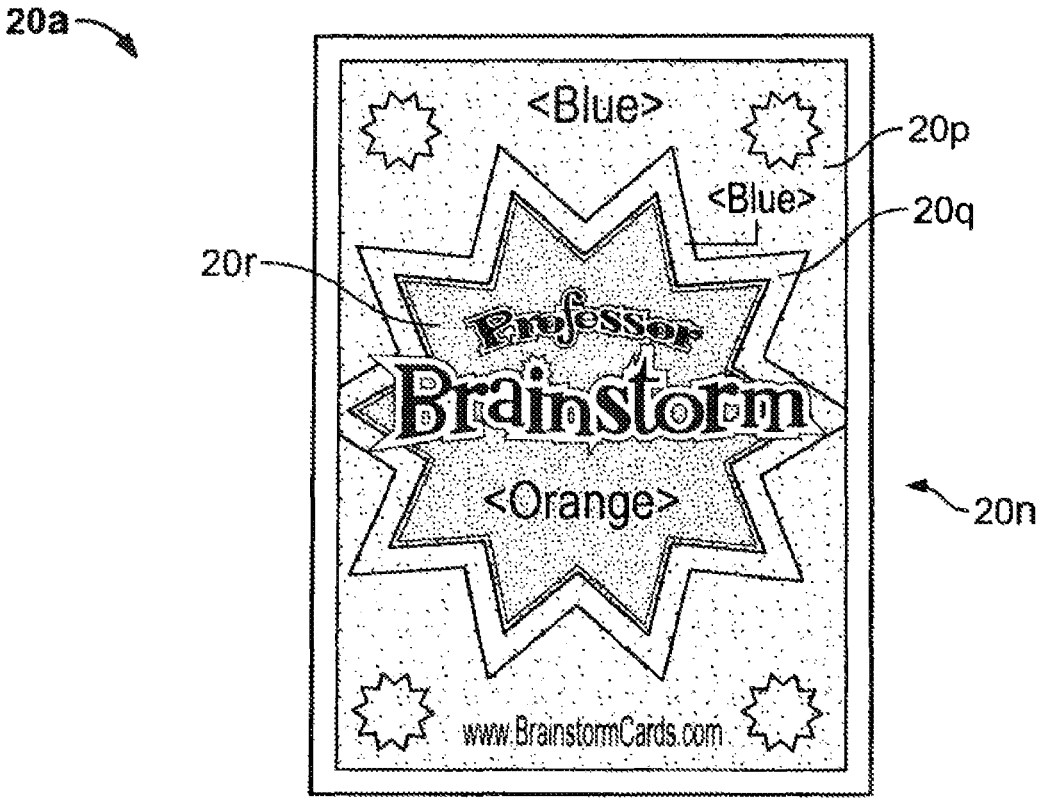
Figure 8:
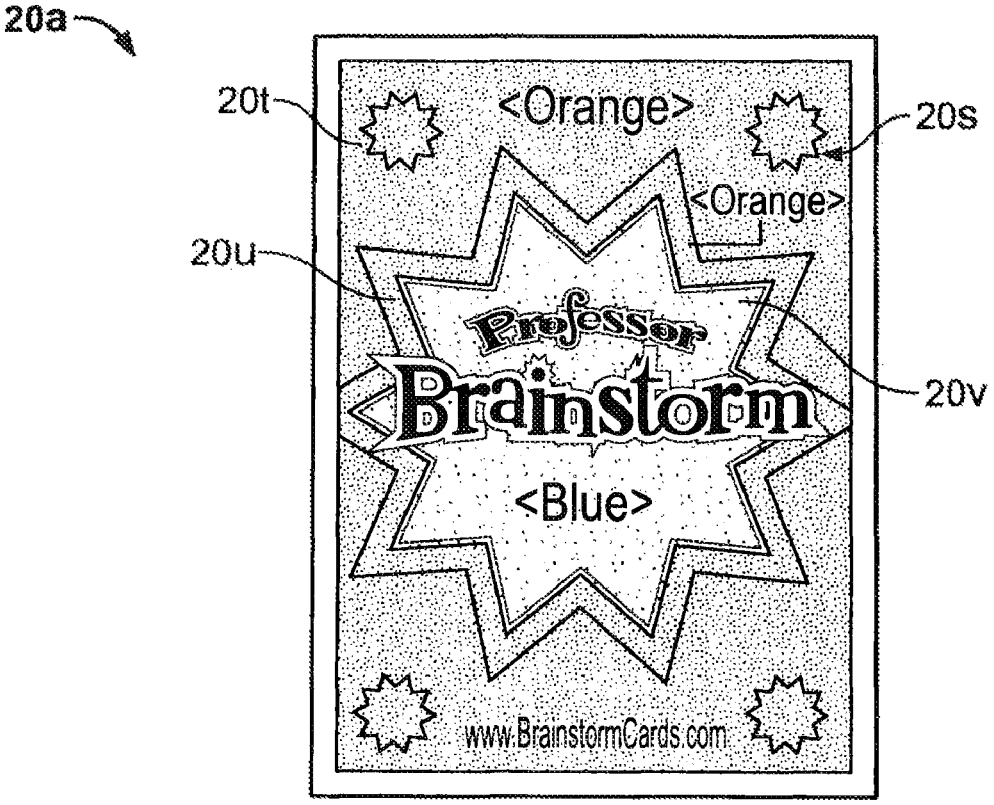
Figure 9:
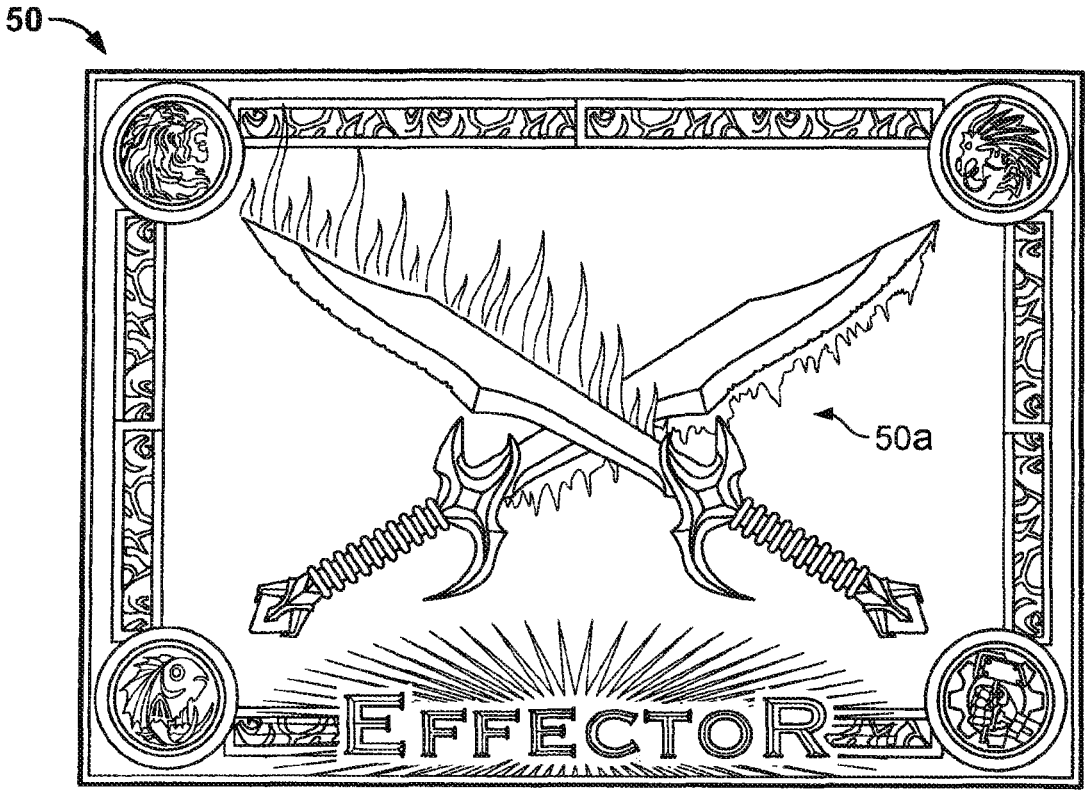
FIGS. 9-10 are plan views of turn-identifying symbols, wherein the Protector shield indicates that the player has a defensive position and goes first during a round of play and the Effector swords indicate that the player has an offensive position and goes second during a round of play.
Figure 10:
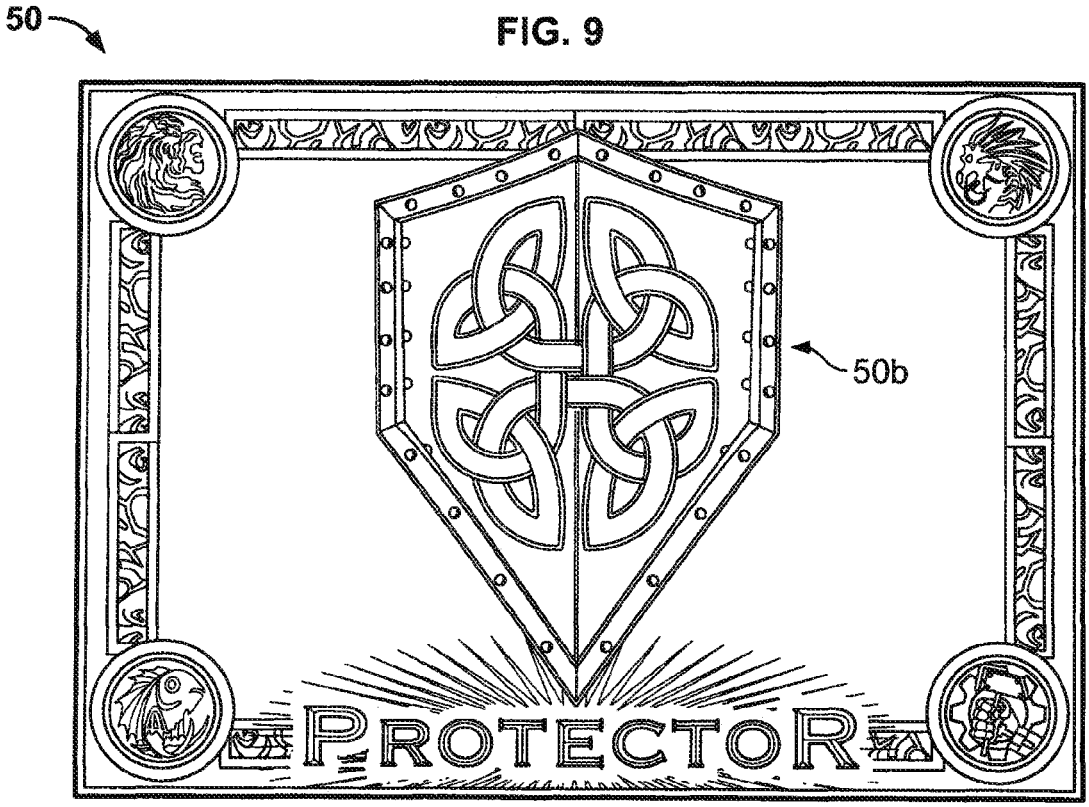
Figure 11:
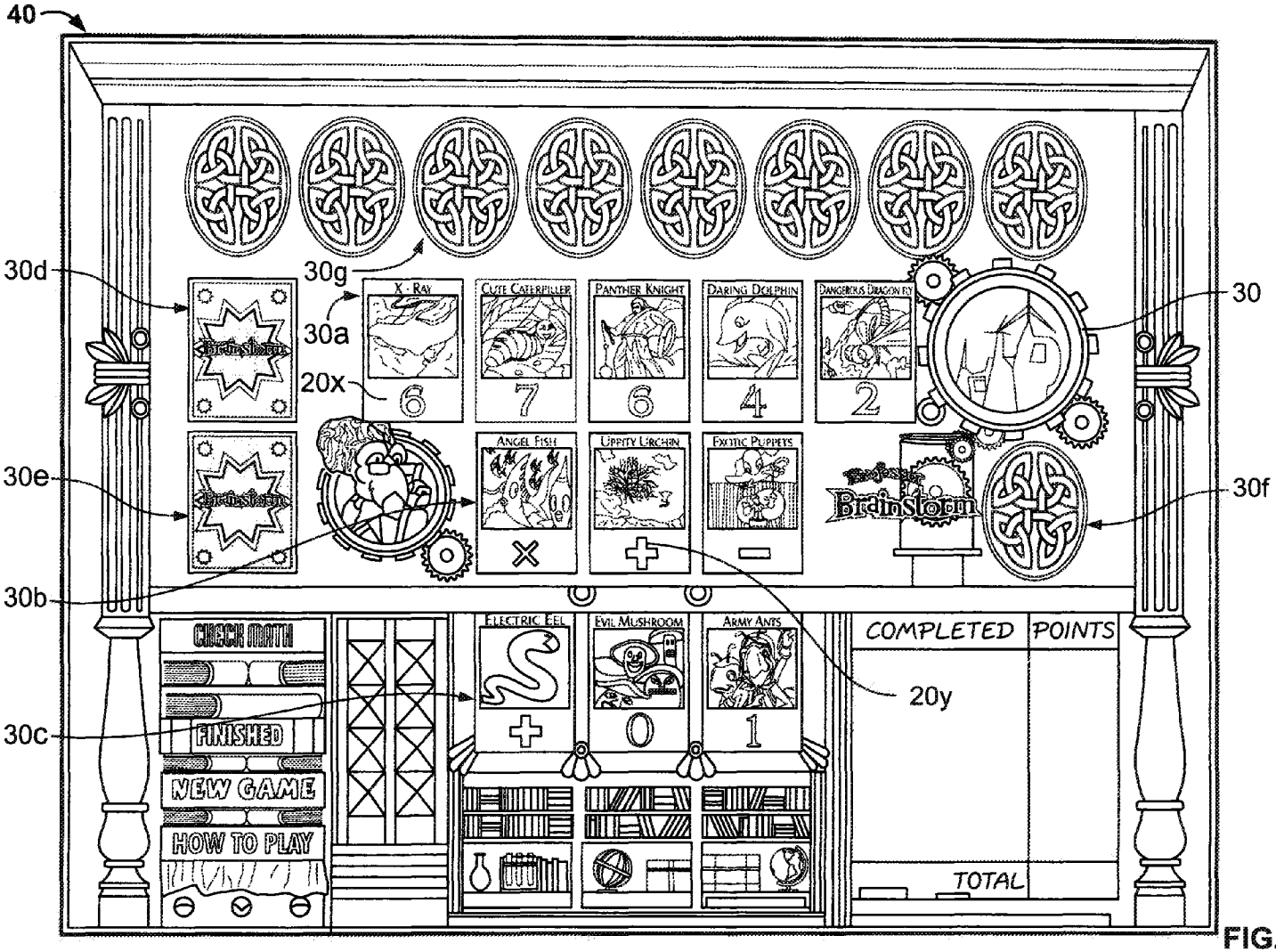
FIG. 11 is a plan view of a screen shot of an electronic version of an alternate educational game in accordance with the present invention, illustrating representations of playing cards displayed on a playing field.

In the embodiment of a game component, such as the playing card 20 illustrated in FIG. 3, educational information, e.g., an expression portion in the form of a letter 20*e*, is displayed. The letter 20*e* forms part of an expression, such as a word, to be formed by the user during game play. In a preferred form, an educational game according to the present invention has first and second game components being of first and second game component types. For example, a first game component is a collectible playing card having a consonant type. The second game component is a collectible playing card having a vowel type. Prior to being played to form a word, consonant cards 20*aa* are kept separate from vowel cards 20*ab*. The consonant cards 20*aa* are distinguished from the vowel cards 20*ab* using indicia for grouping the cards, such as a differing color scheme used to break the cards up into different sets. For example, FIGS. 7 and 8 show card backs 20*n*, 20*s* of the consonant and vowel cards 20*aa*, 20*ab*. Consonant card backs 20*n*, shown in FIG. 7, have a blue background 20*p*, a blue border or outline 20*q*, and an orange-colored star 20*r*. On the other hand, vowel card backs 20*s* have an orange background 20*t*, an orange border or outline 20*u*, and a blue-colored star 20*v*. Other indicia for grouping the cards may include borders on the face of the cards 20, symbols, and the like. In a preferred form, the borders are associated with a kingdom identifier 20*k*, such that each kingdom (described in more detail below) has a unique border. This will help the user keep different sets of cards or decks separate from other sets of cards or decks. This association helps the player learn the differences between vowels and consonants and will start the individual on their way to forming words.

Figure 5:
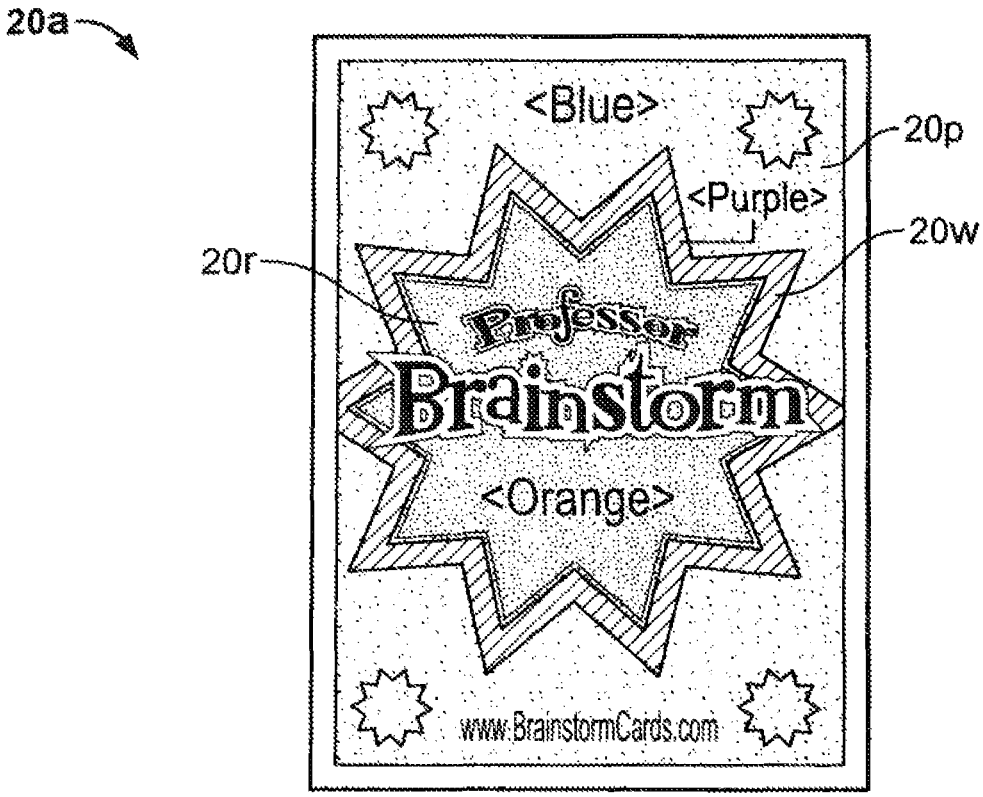
FIGS. 5-8 are plan views of the back of playing cards in accordance with the present invention having indicia of various colors to distinguish one type of card from another.
Figure 6:
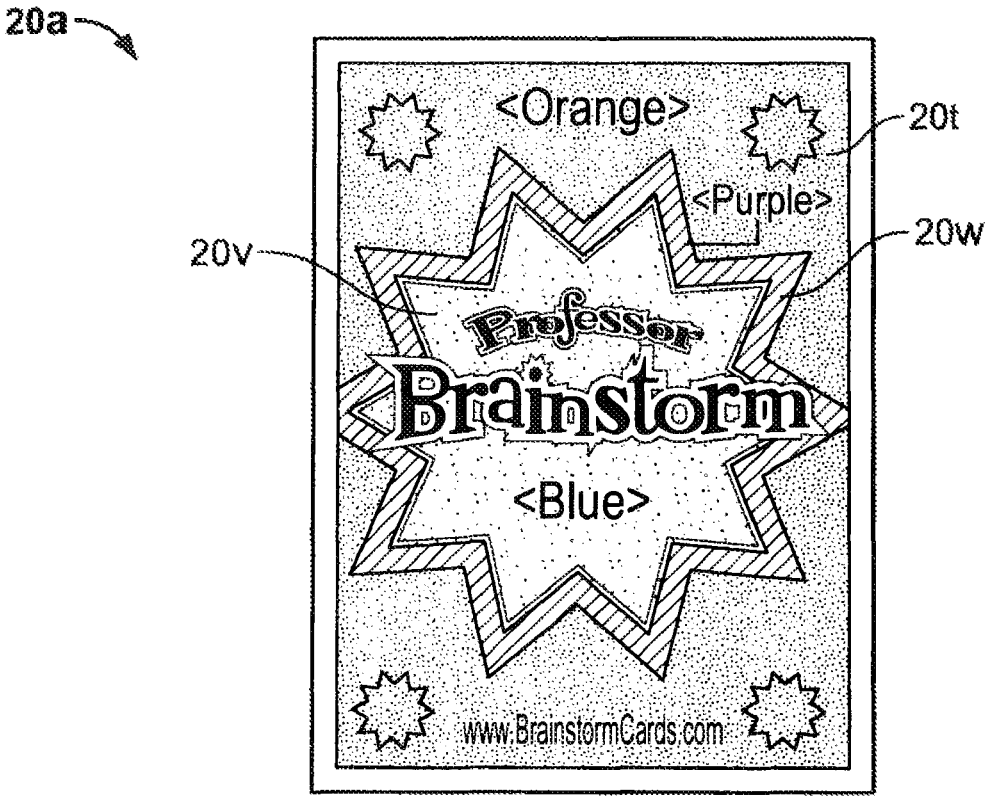

Other types of cards 20 may be further distinguished from consonant and vowel cards 20*aa*, 20*ab* and each other using different color schemes. Card backs 20*a* shown in FIGS. 5 and 6 for an alternate embodiment, such as a mathematical equation or expression forming game 40, have differing color schemes. The card back shown in FIG. 5 is for a first card type, such as a number card 20*ac*, and has a blue background 20*p*, a purple border 20*w*, and an orange-colored star 20*r*. The card back shown in FIG. 6 for a second card type, such as a number or a mathematical operator card 20*ad*, has an orange background 20*t*, a purple border 20*w*, and a blue-colored star 20*v*. In this manner, the equation-forming cards 20*ac*, 20*ad* having numbers 20*x* or mathematical operators 20*y*, are distinguished from the word-forming cards 20*aa*, 20*ab* primarily based on the purple border 20*w* which surrounds the stars 20*v*, 20*r*. Although subtle, all of these associations with indicia, such as color, help educate the user or individual (e.g., such as the difference between consonants, vowels, numbers and/or mathematical operators). The indicia will also help the user categorize or group the cards and keep different card sets or decks separate or apart from one another if desired.

In addition to or in lieu of allowing players to play the word game 10 head-to-head or to play the mathematical/equation game 40 head-to-head, a preferred form of the invention will allow both the equation-forming game 40 and the word-forming game 10 to be played together, such that one player forms equations with the cards 20*ac*, 20*ad* and plays against another player who forms words with the cards 20*aa*, 20*ab*. During game play, or if a player has both the equation-forming game 40 and the word-forming game 10, cards may become intermingled. Thus, the differing color schemes on the card backs are operable to help the players separate both cards of different types as well as cards belonging to different games. Additional indicia, such as a border can be used to further assist in grouping the cards into different sets or decks, therefore making it easier to sort one set or deck of cards from another.

A playing card 20 may include a description 20*f*, which may comprise information, such as a power or effect 20*h* of the particular card, background information regarding the character, instructions on how to execute the power or effect of the card, commands, stories, or other information. In FIG. 3, the description 20*f* reads "[r]emove one earth creature's points from other player's shield field." Thus, this description embodies a power or effect 20*h* over another player's cards 20 that have been played in the expression field or shield field 30*g*. Other examples of powers or effects 20*h* are seen in the description fields 20*f* in FIGS. 4 and 12-15.

A playing card 20 may also have a value, such as a point value 20*g*, which is denoted within a star below the character illustration 20*c*. The point value preferably ranges between 1 and 3 points. Cards 20 containing expression portions that are more common, such as letters 20*e* used frequently like the letter "A" shown in FIG. 3, may have a point value of 1. Less common expression portions, like letters used less frequently, such as the letter "V", may have a higher point value, such as a value of 3. This type of point valuing system encourages the player to use expression portions that may be more difficult to incorporate, thus rewarding the player for forming expressions that are less common or more difficult to form. By doing so, the game not only helps teach word formation and arithmetic, but encourages players to challenge or press themselves to engage in more advance word formation or arithmetic.

Figure 12:
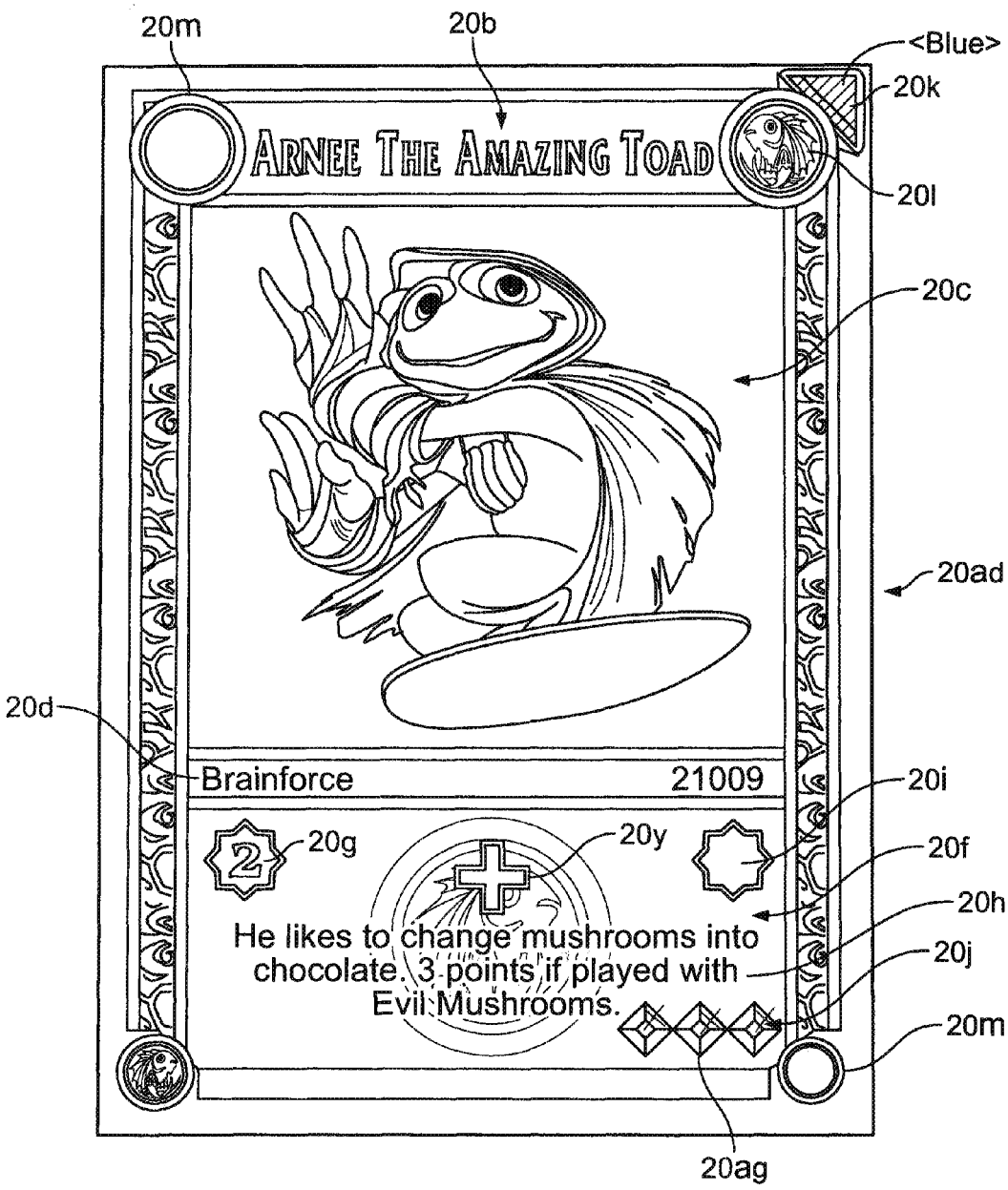
FIG. 12 is a plan view of a playing card in accordance with the present invention illustrating a title, a character illustration, a mathematical operator, a point value, an effect, a currency designation, and other information.
Figure 13:
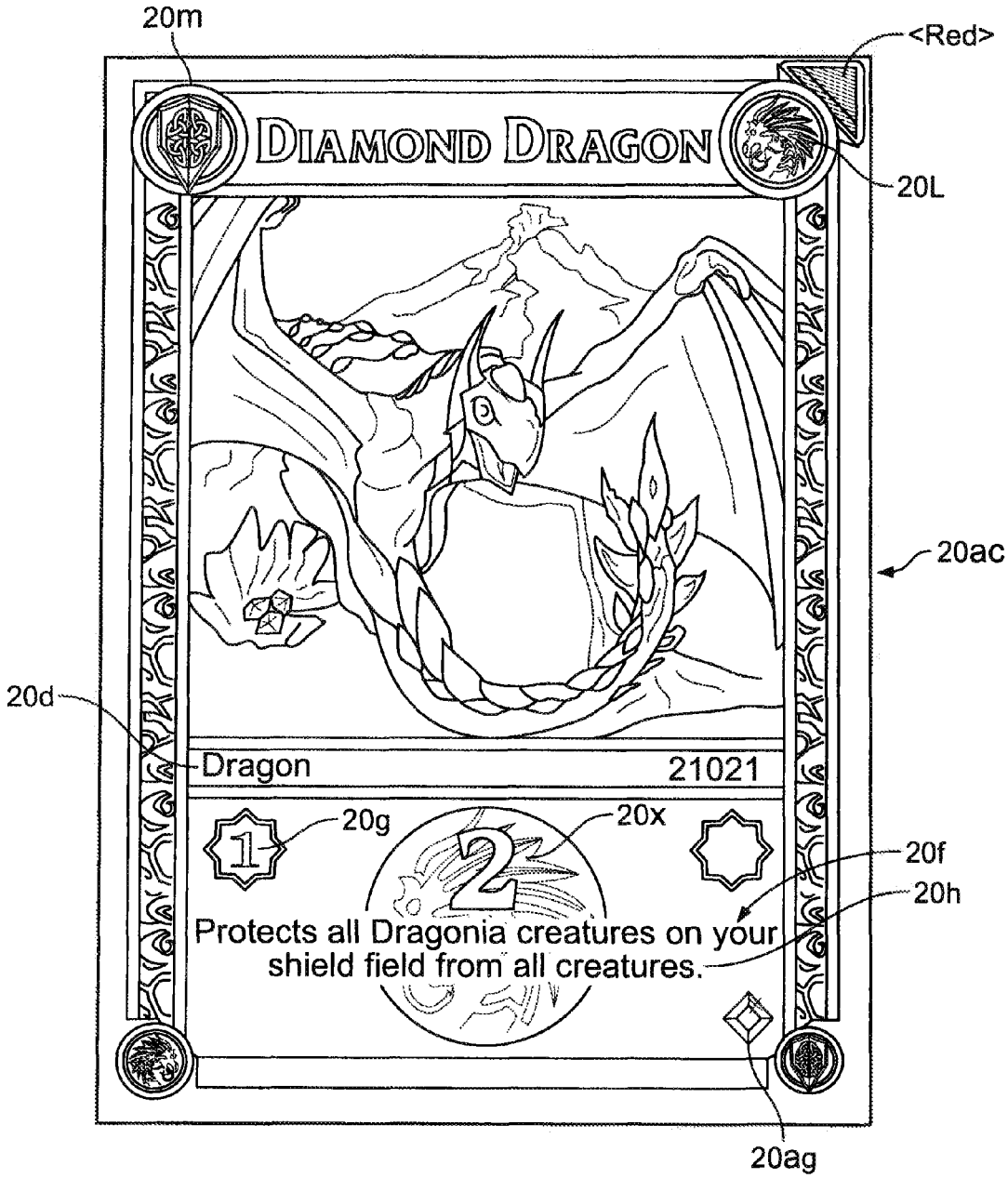
FIGS. 13-15 are plan views of alternate playing cards in accordance with the present invention.
Figure 14:
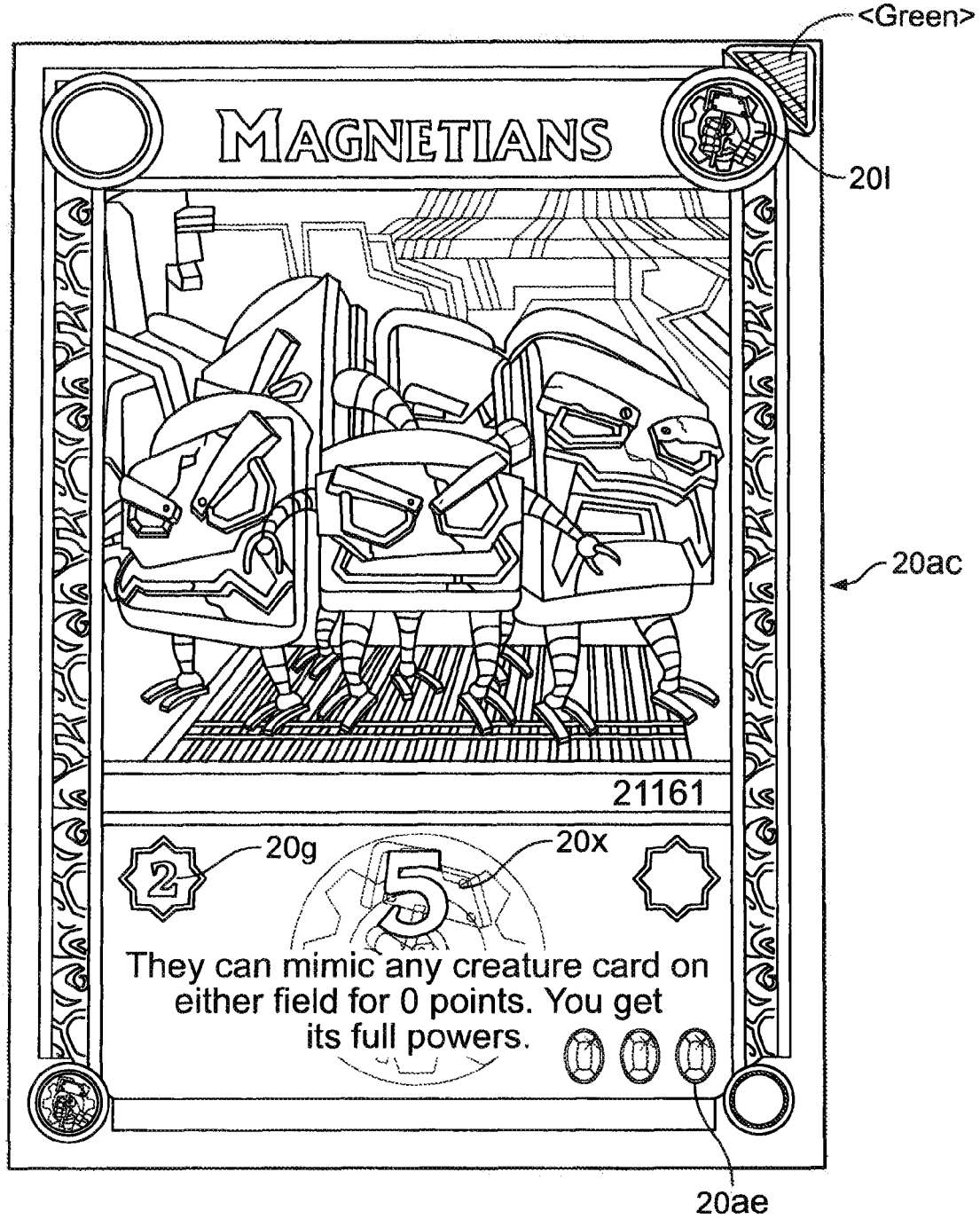
Figure 15:
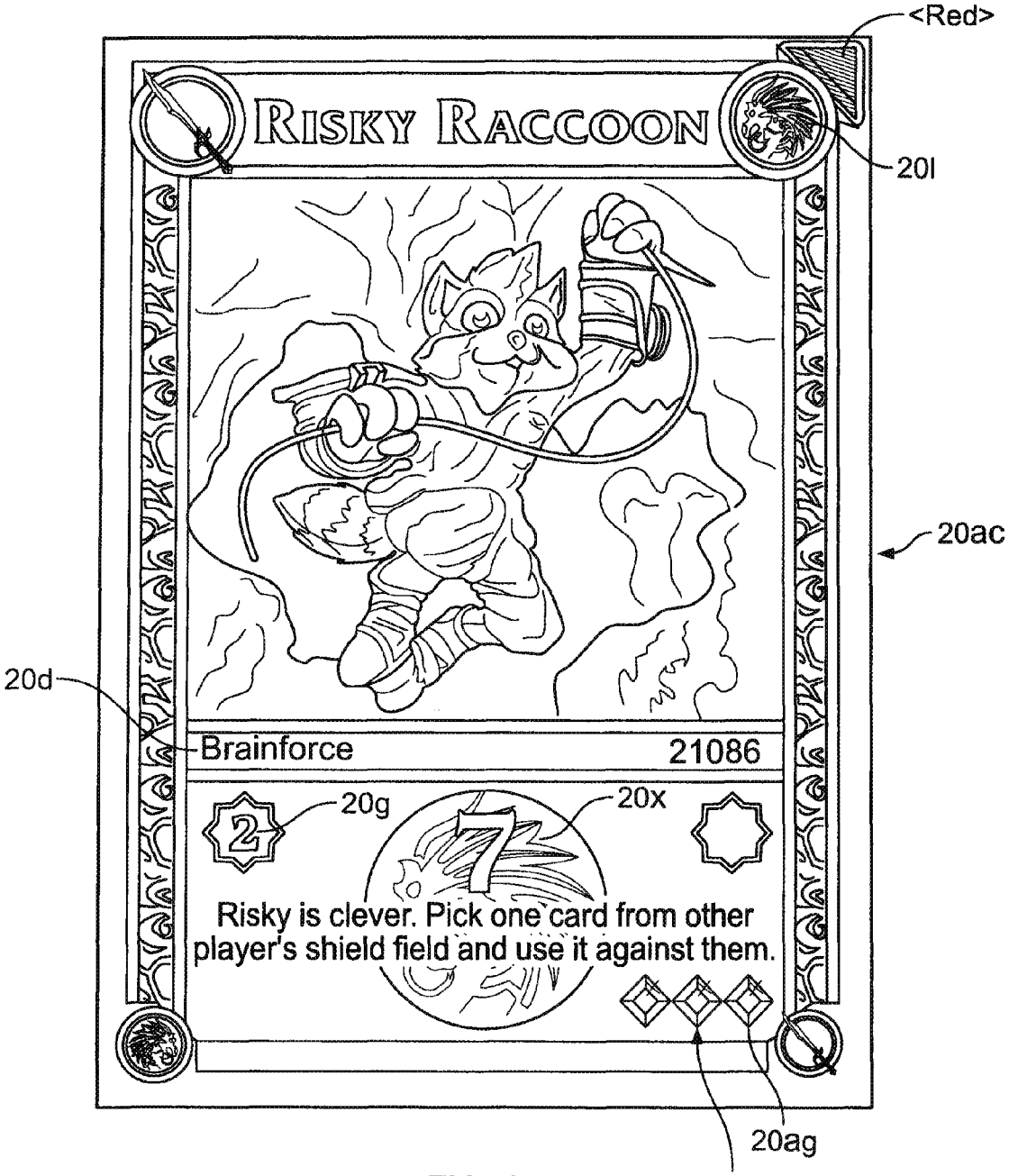
Figure 16:
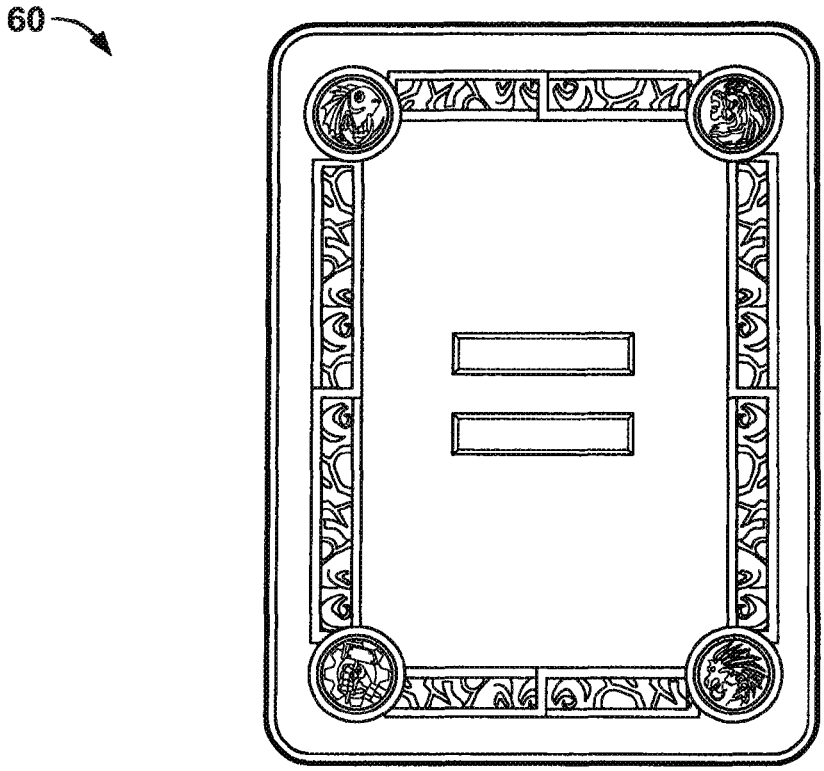
FIGS. 16-17 are plan views of playing cards containing mathematical symbols denoting equality or inequality and are used to build mathematical expressions in accordance with the present invention.
Figure 17:
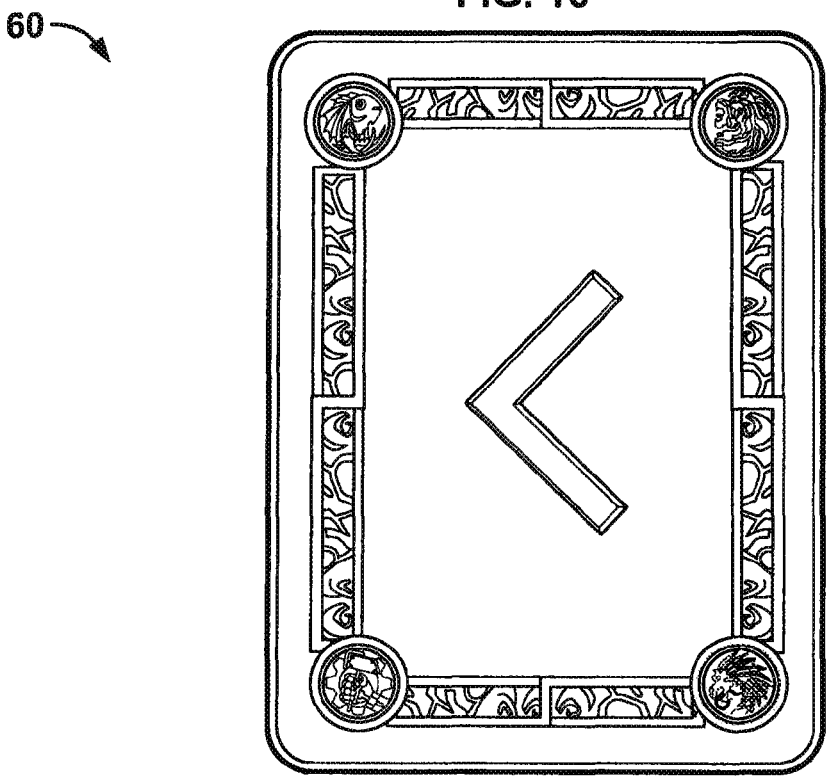

The power or effect 20*h* of a card augments the efficacy or point value of the same or another card 20. For example, a card power or effect 20*h* may reduce another card's point value, such as shown in FIG. 3. Alternatively, a card's power may augment the score of a player's own card or cards. For example, in FIG. 4, the description 20*f* states a player's word points will double if they form a word with five or more letters. In FIG. 12, the description 20*f* states the card's power increases the point value of the card from 2 to 3 if the card is played together with the "Evil Mushrooms" card. Other powers 20*h* may include protecting a card or cards from the effects of other cards. For example, the power 20*h* described in FIG. 13 protects "Dragonia" creature cards played by the user from all other creatures. A further example of a power 20*h* in FIGS. 14 and 15 is that a card may adopt the power of another card. In FIG. 14, the card may mimic any card on the field, while in FIG. 15, the player of the card may pick one card in the other player's shield field 30*g* and use it against the other player. Thus, it can be seen that the powers and effects 20*h* of each card are operable to increase the complexity and depth of the game, making the game more interesting for experienced players. In addition, the powers and effects 20*h* motivate the players to read and reread each card before putting it into play, which encourages and develops reading skills in general but also proof-reading skills.

As described above, the game components, such as playing cards 20, are generally divided into first and second game component types. Either of the first or second game component types, such as consonant and vowel cards 20*aa*, 20*ab*, may have powers, which are described in the card description 20*f*. In addition, certain cards of the second game component type, such as vowel cards 20*ab*, may have effects 20*h* that may be played in either the expression field 30*g* or an effect subfield 30*f*. These cards are referred to as effect cards in the present form and generally have effects such as storms and other worldly phenomena which create conditions to adjust a player's offensive or defensive advantage. In one method of playing, an effect card loses its effect if it is played to form an expression, such as a word. Alternatively, the effect card may be played in the effect subfield 30*f*, wherein it is not used to form a word, but is solely used for its effect. An effect duration indicator 20*i* located below the character illustration 20*c* is provided to inform the user how long the effect lasts. Preferably, an effect 20*h* lasts one to two turns.

An effect card is preferably designated by a symbol in the kingdom identifier field 20*l*. Non-effect cards, which may be referred to as power cards, may be further classified using the kingdom identifier field 20*l*. In one form, each power card may be identified by one of four symbols representing imaginary kingdoms from which each character originates. The four kingdoms in the present embodiment are Dragonia, represented by a dragon symbol, as shown in FIGS. 13 and 15; Hydra, represented by a fish symbol, illustrated in FIG. 12; Industria, represented by a robotic hand and hammer symbol and shown in FIG. 14; and Terra, represented by a lion's head, as illustrated in FIGS. 3 and 4. It should be understood, however, that other symbols may be used to represent kingdoms or that items other than kingdoms may be used to distinguish different groups or sets of cards.

As effect cards are preferably associated with the second card type, such as vowel cards 20*ab* in the case of the word-forming game 10, a user must use strategy to decide whether an effect card is best used as a vowel to form a word or used solely as an effect. Although the effects can be very helpful to a player's offensive or defensive position during a round, vowel cards 20*ab* are also needed to form words. Thus, the more vowel options a player has, the easier it will be to form longer words, which are also worth more points. Therefore, a player must make judgments as to when using an effect card solely for its effect is most beneficial to the outcome of the game. This aspect makes the game more challenging and interesting for more experienced users.

Another aspect of the current invention is that the game may be modified or scaled depending on the skill of the user. For example, the powers or effects of a game component may be disregarded or disabled in order to simplify game play. Younger users may not be able to read the card descriptions 20*f* or may have trouble with the effects 20*h* and their applicability to the game. Advantageously, the game may be played without using the power or effect functionality of the cards 20. This allows score keeping and game play to be simplified. Conversely, more advanced users may incorporate the power and effect functionality of the cards 20 to tailor the game to their skill level.

In the present embodiment, the playing cards 20 are preferably collectible in that the cards 20 not only have utility for playing a game, but may also be used for collection purposes. To assist with the collectibility, an additional aspect of a game component in accordance with the present invention is a currency designator 20*j*. The currency designator 20*j* includes a symbol or symbols designating the relative value or rarity of a card. In the present embodiment, the currency takes the form of images of rubies 20*ae*, emeralds 20*af*, and diamonds 20*ag*, in increasing order of value and rarity. Thus, a card having three rubies 20*ae*, such as the one in FIG. 3, has less value than a card having three diamonds 20*ag*, such as the card in FIG. 15. These indications of value are useful to determine relative worth of a given card when players wish to buy, sell, or exchange cards 20.

A game component may be further classified or categorized via an elemental designator 20*k*. According to the present invention, the elemental designator 20*k* is a triangular tab on an upper corner of the playing card 20 having a color correlating with a given element. The elements are preferably fire, water, wind, and earth, represented respectively by the colors red, blue, silver and green. For example, the cards 20 in FIGS. 3 and 4 are associated with the earth element, indicated by the green triangle at the upper right hand corner of the card 20. Similarly, the cards 20 illustrated in FIGS. 13 and 15 are associated with the fire element, indicated by the red triangle at the upper right hand corner of the cards 20. The elemental designator 20*k* is used in some circumstances with the powers and effects 20*h* of other cards 20. For example, a power 20*h* of a card may be such that it only has an effect on cards of a certain element. In FIG. 3, the power 20*h* of the card shown is only effective on earth creatures. Thus, if the opposing player had played a card having a green triangle, such as the "Double Dinos" card in FIG. 4, he would have to deduct one point from his score for that particular round.

Additional information about the game component may be provided in the form of an offensive or defensive symbol 20*m*, which in the present embodiment is called a "force medallion." The force medallion 20*m* may take the form of either a sword, indicating an offensive posture to the power or effect of the card 20; a shield, indicating a defensive posture of the power or effect of the card; or a blank circle, indicating neither an offensive or defensive posture to the power or effect of the card. Preferably, the force medallion 20*m* is disposed on the card at opposite outer corners of the card, such that a user may quickly see the strategic posture of the card while holding the card in his hand, regardless of how the cards 20 are held, i.e., with the cards 20 fanned from left to right with the left most card on top, such that the lower right corner of each card is visible, or alternatively, with the left most card on the bottom, such that the upper left corner of each card is visible. Similarly, a player may quickly glance at an opponent's cards 20 on the playing field to determine which cards 20 may be used against his cards in an offensive or defensive manner.

In an alternate form shown in FIG. 12, a game component may take the form of a collectible playing or trading card 20 used for playing a mathematical expression- or equation-forming game 40. The cards 20*ac*, 20*ad* are similar to the cards shown and described in FIGS. 3 and 4, except that the expression portion contains a number 20*x* or a mathematical operator 20*y* instead of a letter 20*e*. Similar to the letter cards described above, the present playing cards also preferably include a card back 20*a*, a title portion 20*b*, a character illustration 20*c*, character type information 20*d*, a card description 20*f*, a point value 20*g*, an effect 20*h*, an effect duration indicator 20*i*, a currency designator 20*j*, an elemental designator, 20*k*, a kingdom identifier 20*l*, and a defensive or offensive effect indicator 20*m*.

Like the cards 20*aa*, 20*ab* for the word-forming game, the equation-forming cards 20*ac*, 20*ad* are split into two groups. Preferably, the first card type is a number card 20*ac*, having a number 20*x* between 2 and 9, inclusive. The second card type is a number or a mathematical operator card 20*ad*, having a number 0 or 1 or a mathematical operator 20*y*, such as plus, minus, multiplication, and division signs (+, −, ×, ÷). The first and second card types are preferably distinguished using indicia, such as color, on the card backs 20*a*. The cards are used similarly to the letter cards 20*aa*, 20*ab* described above, except that the player forms mathematical equations or inequalities using the cards instead of words.

Now, with respect to playing the games, in one form of the word form game 10, each player has a deck of at least 50 cards with preferably more than three copies of any one card. The deck is separated into two draw piles: a blue draw pile placed on the blue deck field 30*d* consisting of consonant cards 20*aa* and an orange draw pile placed on the orange deck field 30*e* consisting of vowel and effect cards 20*ab*. Preferably, each player will have a minimum of 20 orange and 30 blue cards. However, any number of cards may be used as desired.

Both players begin by setting up their cards 20 on the playing field 30. The first step is to draw five cards 20*aa* from the blue draw pile and place them face up in the five blue card spaces of the upper tier or upper base 30*a* on the playing field 30. Next, each player draws six cards 20*ab* from the orange draw pile. Each player then places three of those cards 20*ab* face up on the three orange card spaces of the lower tier or base 30*e*. The three cards 20*ab* remaining in the player's hand are called the blind or pocket cards as mentioned above and are held or kept out of view of an opposing player, if any. The pocket cards can be used anytime during a player's turn to build a word.

Once the cards 20 are set up, play begins. The object of the game is to build words for points using any combination of the letters on the cards 20 in the upper base 30*a*, lower base 30*b*, and the pocket 30*c*. The cards 20 are combined just above the upper base 30*a* in the expression field or shield field 30*g*. A player's strategy can involve creating the most points in his word, taking a defensive posture by protecting his word against attacks by an opponent, or taking an offensive posture by playing cards 20 that can remove points from the other player's word.

Players alternate the order of play each round. The player to play his cards 20 first is called the Protector. The Protector is a defensive position by nature, because the opponent's cards 20 are not yet played, so there are no cards to attack. The Protector must anticipate the cards 20 that the Effector might play, based on studying the cards 20 in the Effector's upper and lower bases 30*a*, 30*b*. The Effector plays second and is by nature an offensive position, as the Effector knows what cards 20 the Protector has played when the Effector starts his turn. Thus, the Effector may choose his cards 20 in response to the cards played by the Protector, and therefore has an advantage in attacking the Protector's cards 20 using cards with the appropriate powers or effects.

Each deck preferably includes a Marker Card 50 (see FIGS. 9 and 10) which is used to keep track of which player is the Effector and Protector during each turn. The Effector is represented by a sword icon 50*a* and the Protector by a shield icon 50*b*.

The Protector always plays his cards 20 first. He starts by reading the powers or effects of the cards 20 he wishes to play. The Protector then builds his word on the shield field 30*g*, keeping in mind the cards 20 the Effector has in her upper and lower base 30*a*, 30*b*. Any card that can be used against another player's cards 20 has an offensive effect indicator 20*m* in the form of a sword icon on the upper left corner. Any card that can be used to protect a player's Shield field 30*g* has a defensive effect indicator in the form of a shield icon. The Protector can, if he chooses, play a defensive effect card from his pocket in the effect subfield or space 30*f* to defend his word.

The Effector then builds her word on the shield field 30*g* keeping in mind the cards 20 the Protector has in his word. The Effector can then play any effect card by placing it in the effect space 30*f*. However, there can only be one effect card in this space 30*f* at one time. Effect cards stay in play a number of turns equal to the number in the effect duration indicator 20*i*, which is located to the right of the letter 20*e*. If the vowel on the effect card is used to build a word on the shield field 30*g*, the effect cannot be used.

At this time, if the Effector has played an effect card, the effect is unleashed on the shield fields 30*g*. Any cards 20 that have points removed by the effect are twisted out or turned sideways to show that they are no longer in play. Next, the Effector's cards 20 located in the shield field 30*g* to form a word are used to remove points from the Protector's cards 20 in their shield field 30*g*. Any cards 20 that have points removed are then twisted. Once this is done, the Protector's cards 20 that have not been twisted can now be used on the Effector. The Effector's cards 20 that have had points removed are also twisted out.

After all of the effects have been applied, the round is over and each player adds up their score from their shield field 30*g*. Each player's points are added (or subtracted) from their total score.

All cards 20 are then cleared from the shield field 30*g*, leaving the remaining cards 20 in the upper and lower bases 30*a*, 30*b* in place. Any empty spaces in the upper and lower bases 30*a*, 30*b* are refilled from the blue and orange decks, respectively. In addition, each player draws enough cards 20 from the orange draw pile until they have three cards 20 in their pocket 30*c* to replace the cards 20 used in the previous turn. The effect spaces 30*f* are also cleared unless the given effect lasts more than one round.

The players then flip their marker cards 50, switching their roles as Protector and Effector, and play continues in an alternating fashion until a player wins the round by reaching 50 points, or an agreed upon number. A match is won by the first player to win two rounds, or an agreed upon number of rounds.

In another form in accordance with the present invention, an equation-forming game 40 is played in a similar manner as the word-forming game 10 described above, with slight variations as described below. Each player has a deck of at least 50 cards with no more than 3 copies of any one card. The deck is separated into two draw piles, wherein the blue draw pile consists of numbered cards 20*ac* having a number between 2 and 9, inclusive. The orange draw pile consists of cards 20*ad* having a 0, 1, or a mathematical operator which may collectively be referred to as operators. In addition to the orange and blue cards, the game includes an equality/inequality card, called a gizmo card 60, which has an equal sign (=) on one side and a greater than/less than sign (>/<) (depending on what direction it is turned) on the other side. The gizmo card 60 is used in every turn by each player to form a mathematical expression.

Accordingly, the object of the present game is to build mathematical expressions such as equations or inequalities to acquire points using any combination of the numbers and operators located in the upper and lower bases 30*a*, 30*b* and the pocket 30*c*. One example would be to combine the cards 20*ac*, 20*ad* of FIGS. 12-15 to form the equation 2+5=7. Alternatively, a player could form the expression 7+5>2 by flipping over the gizmo card 60 to implement the "greater than" symbol. The greater than/less than symbol allows a player to form an expression regardless of the cards 20*ac*, 20*ad* in play. A player may also have expressions on either side of the equal sign or greater than/less than sign. For example, an expression could read 5+2=3+4. This equation would be worth more points than the prior examples, as more cards 20*ac*, 20*ad* are required to form the expression. A player's strategy can involve creating the most points in his equation, protecting the equation with defensive effects 20*h*, and playing cards with offensive effects 20*h* that can remove points from the other player's equation.

The equation-forming game 40 may be customized to accommodate a varying level of user abilities and preferences. For example, the game may be simplified for users with lower math proficiencies by removing cards 20*ad* with multiplication or division signs from the orange deck, such that the game is played solely with the plus and minus signs. Further, as in the word-forming game 10, the game may be played without using the card effects and powers 20*h* to simplify game play and scoring.

In another form of the invention, the playing field may have an operator, such as an equal sign and/or greater and less than signs, permanently positioned on the playing field so that the players do not have the option of using the gizmo card. For example, in one form, the playing field may be two sided, with one side being configured to play the word game 10 and the other side having the permanent operator in place for playing of the equation game 40. In such embodiments, the permanent operator will normally be an equal sign, which will make the game harder to play. In alternate forms, however, the permanent operator may actually include all operators and simply allow the players to select which one they are using rather than requiring them to use a card such as the gizmo card 60.

Although the embodiments disclosed herein have been described with respect to a card game, the game may take numerous forms. In another form, the game may be played electronically, such that the game components and playing field are electronic representations of playing cards or other game pieces. An electronic form of the game may be played on any electronic device, either locally or on the internet or via an intranet connection, on a computer or a handheld electronic device, e.g., a mobile phone, handheld computer, Personal Digital Assistant, GPS device, personal music player, and the like.

Although the game has been described as being played with two players, it may be played by more than two players, as individuals or as teams, or alternatively with just one player. Although the word-forming game 10 and the equation-forming game 40 have been described as separate embodiments, the games may be played simultaneously, such that a first player plays the word-forming game 10 against a player playing the equation-forming game 40. Because of the similarities between the game components and rules, an equation can be played against a word without any change in the format or play of the game. It should also be understood that the game field may take the shape of many different media. For example, in a physical game, it may be a game board, game mat, or thin piece of paper. Alternatively, as mentioned above, if the game is played electronically, the game field may be displayed electronically on a screen or other type of display.

While the invention has been described with respect to specific examples including presently preferred modes of carrying out the invention, those skilled in the art will appreciate that there are numerous variations and permutations of the above described systems and techniques that fall within the spirit and scope of the invention as set forth in the claims.

What is claimed is:

1. An educational game, comprising:

a first game component having either a first letter or a first number; a first point value and a first type indicator which indicates the first game component type;

a second game component having either a second letter, a second number, or a mathematical operator; a second point value and a second type indicator which indicates the second game component type, wherein the second game component type is different than the first;

a playing field having first, second, and third game component fields, wherein the first game component field has a predetermined area for a game component of a first game component type, the second game component field has a predetermined area for a game component of a second game component type, and the third game component field has an area for game components of either the first or second game component type, wherein the first letter or first number of the first game component and the second letter, second number, or mathematical operator of the second game component are combinable to form an expression having a point value based on at least the first and second point values.

2. The educational game of claim 1, wherein the first game component type is a consonant and the second game component type includes a vowel, such that a word may be formed by a user in the third game component field using first and second game components.

3. The educational game of claim 1, wherein the first game component type is a number, and the second game component type is a number or an operator, such that a mathematical expression may be formed by a user in the third game component field using first and second game components.

4. The educational game of claim 1, wherein the first or second game components include an effect, wherein the effect may affect the efficacy or point value of other game components.

5. A method of playing an educational game, comprising:

providing a plurality of game components with first and second game component types each having a predetermined point value, wherein a first game component type is one of a letter and a number and the second game component type is at least one of a letter, a number, and a mathematical operator, wherein at least one of the first and second game components includes an effect which augments the efficacy or value of at least one game component;

selecting at least one first game component and at least one second game component;

placing at least the first and second game components in a playing field; and forming an expression with the first and second game components.

6. The method of claim 5, further comprising initiating an effect on at least one of the game components by placing at least the first and second game components in a playing field and augmenting the efficacy or point value of the at least one game component.

7. The method of claim 5, further comprising creating a set of first and second game components from a predetermined number of the first and second game components;

selecting first and second game components from the set to form an expression in the playing field.

8. The method of claim 7, wherein the set is comprised of two separate fields including a first field for containing a predetermined number of first game components and a second field for containing a predetermined number of second game components.

9. The method of claim 8, wherein the predetermined number of first game components is five and the predetermined number of second game components is three.

10. The method of claim 8, further comprising a third field for containing a predetermined number of second game components for use in forming expressions or initiating effects on the at least one game component; and selecting the at least one second game component; and placing the at least one second game component in the third field.

11. The method of claim 5, wherein the first game component type is a consonant, the second game component type is a vowel, and forming an expression with the first and second game components includes forming a word.

12. The method of claim 5, wherein the first game component type is a number, and the second game component type is a number or an operator, and forming an expression with the first and second game components includes forming a mathematical expression.

13. The method of claim 12, further comprising providing a one of an equality symbol, a greater than symbol, and a lesser than symbol; and forming a mathematical expression by selecting one of the equality, greater than, or lesser than symbols in combination with the first and second game components, wherein at least one of the second game components is an operator.

14. An educational game, comprising:

a first game component having a first symbol designating a first expression portion for the first game component; a first power field indicating the power or effect of the first game component over the first game component or other game components; a first point value; a first game component type identifier to distinguish the type of game component between the first game component and a second game component having a different type than the first game component;

a second game component having a symbol designating a second expression portion for the second game component, a second power field indicating the power or effect of the second game component over the second game component or other game components; a second point value; a second game component type identifier to distinguish the type of game component between the first game component and the second game component having a different type than the first game component;

wherein the first and second game components may be combined during game play to form an expression comprised of the first and second symbols, the expression having a point value based upon the sum of the first and second point values.

15. The educational game of claim 14, wherein the first and second expression portions are letters, and the expression is a word.

16. The educational game of claim 14, wherein the first and second expression portions are one of a number and an operator, and the expression is a mathematical equation or inequality.

17. The educational game of claim 15, wherein the first expression portion is a consonant, and the second expression portion is a vowel.

18. The educational game of claim 16, wherein the first expression portion is a number and the second expression portion is a number or an operator.

19. The educational game of claim 18, wherein the first expression portion comprises one of a number between 2 and 9, inclusive, and the second expression portion comprises one of the numbers 0 and 1 or a mathematical operator.

20. The educational game of claim 14, further comprising a playing field having separate first and second portions for holding the first and second game components prior to being played to form the expression.

21. The educational game of claim 15, wherein the first portion holds five first game components and the second portion holds three second game components, and the playing field further comprises an expression field for containing the first and second game components selected by a user to form the expression.

* * * * *